US005422549A

United States Patent [19]

Shepard et al.

[11] Patent Number: 5,422,549

[45] Date of Patent: Jun. 6, 1995

[54] RFQ DEVICE FOR ACCELERATING PARTICLES

[75] Inventors: Kenneth W. Shepard, Park Ridge; Jean R. Delayen, Naperville, both of Ill.

[73] Assignee: The University of Chicago, Chicago, Ill.

[21] Appl. No.: 100,320

[22] Filed: Aug. 2, 1993

[51] Int. Cl.[6] ..... H01J 23/00

[52] U.S. Cl. ..... 315/505; 315/5.41; 315/5.42

[58] Field of Search ..... 328/228, 233, 227; 315/5.41, 5.42, 505

[56] References Cited

U.S. PATENT DOCUMENTS

| | | | |
|---|---|---|---|
| 4,404,495 | 9/1983 | Muller | 315/5.42 |
| 4,494,040 | 1/1985 | Moretti | 315/5.41 |
| 4,949,047 | 8/1990 | Hayward et al. | 328/233 |
| 4,992,744 | 2/1991 | Fujita et al. | 328/233 |
| 5,021,741 | 6/1991 | Kornely et al. | 328/227 |
| 5,089,785 | 2/1992 | Hand | 315/5.41 |
| 5,113,141 | 5/1992 | Swenson | 328/233 |
| 5,334,943 | 8/1994 | Sawada | 328/233 |

OTHER PUBLICATIONS

Development of the Different RFQ Accelerating Structures and Operation Experience, H. Klein, pp. 3313–3322, IEEE Transactions on Nuclear Science, vol. NS-30, No. 4, Aug., 1983.

*Primary Examiner*—Sandra L. O'Shea
*Assistant Examiner*—Vip Patel
*Attorney, Agent, or Firm*—Emrich & Dithmar

[57] ABSTRACT

A superconducting radio frequency quadrupole (RFQ) device includes four spaced elongated, linear, tubular rods disposed parallel to a charged particle beam axis, with each rod supported by two spaced tubular posts oriented radially with respect to the beam axis. The rod and post geometry of the device has four-fold rotation symmetry, lowers the frequency of the quadrupole mode below that of the dipole mode, and provides large dipole-quadrupole mode isolation to accommodate a range of mechanical tolerances. The simplicity of the geometry of the structure, which can be formed by joining eight simple T-sections, provides a high degree of mechanical stability, is insensitive to mechanical displacement, and is particularly adapted for fabrication with superconducting materials such as niobium.

22 Claims, 1 Drawing Sheet

RFQ DEVICE FOR ACCELERATING PARTICLES

CONTRACTUAL ORIGIN OF THE INVENTION

The United States government has rights in this invention pursuant to Contract No. W-31-109-ENG-38 between the U.S. Department of Energy and the University of Chicago representing Argonne National Laboratory.

FIELD OF THE INVENTION

This invention relates generally to radio frequency quadrupole (RFQ) devices and is particularly directed to a four-fold symmetric rod and post RFQ design which may be comprised of superconducting material and is useful in accelerating charged particles.

BACKGROUND OF THE INVENTION

Accelerators are used to accelerate charged atomic-sized particles such as ions to very high velocities such that the particles assume the form of a "beam". Beams of energetic particles of this type have a variety of uses in research, medical, industrial and military applications. For example, ion accelerators are used for ion implantation, neutron and radioactive nuclei generation, and in the study of various nuclear and atomic processes. A common device for accelerating charged particles to high velocities applies high frequency alternating electric fields using four poles (or a quadrupole). With the electric fields alternating at radio frequency levels, this type of particle accelerating device is also known as a radio frequency quadrupole (RFQ) linear accelerator. RFQ accelerators are relatively simple in construction and operation, compact, lightweight and portable. These devices are characterized as being capable of accepting large quantities of ions with low kinetic energies and accelerating them to higher energies. The beam accelerated by the RFQ device is generally highly focused due to the strong quadrupole electric field focusing effect.

One of the major disadvantages of current RFQ accelerators is that they are constructed of very precisely made components which are imprecisely mounted within an outer accelerator shell. Complex adjustment mechanisms are required to align the vane tips of the RFQ accelerator in the precise spatial relationship required for uniform field distributions in the four quadrants of the RFQ accelerator. Precise alignment is achieved only by repeated testing and repositioning of the RFQ vane tips. An example of this type of RFQ accelerator can be found in U.S. Pat. No. 4,949,047 issued Aug. 14, 1990.

In an effort to achieve higher surface electric fields for accelerating the particles to higher energies, RFQ devices comprised of superconducting materials have been proposed. Superconducting structures are characterized by high intrinsic Q and, correspondingly, narrow bandwidth. In addition, for low current applications where beam loading is negligible, superconducting structures are sensitive to frequency variations caused by external noise and microphonics (vibration), and ponderomotive instabilities (RF forces). This problem has been addressed in the prior art by a combination of electronic control and mechanically stable geometries. In addition, manufacturing techniques used for superconducting structures are different than those used for normal conducting structures and have an impact on the electromagnetic and mechanical design. For example, demountable joints and sliding contacts may prove to be impractical in superconducting RFQs, with the amount of adjustment likely to be limited to mechanical deformation. Thus, the superconducting RFQ design must be of high strength to provide the electromagnetic mode purity necessary for the requisite insensitivity to dimensional inaccuracies. Finally, increased cooling is required in superconducting RFQs to remove the heat generated by the increased RF currents, particularly in higher current RFQs which are characterized by a certain amount of beam impingement.

Vane-type RFQ structures with four-fold symmetry typically have dipole electromagnetic resonances very close in frequency to the quadrupole resonance which is used for accelerating and focusing the ion beam. Such close-lying modes give rise to small mechanical distortions or errors in the resonant cavity resulting in large changes in the electromagnetic fields. Thus, the resonant cavity structure must be constructed to very tight mechanical tolerances which is particularly difficult when using the fabrication and processing methods required for superconducting materials.

The present invention addresses the aforementioned problems encountered in the prior art by providing a superconducting RFQ device having a simplified geometry which makes use of eight simple "T" sections, provides large dipole-quadrupole mode splitting with a quadrupole mode lower in frequency than the dipole mode, has four-fold rotation symmetry, and affords a high degree of mechanical stability and tolerances.

OBJECTS AND SUMMARY OF THE INVENTION

Accordingly, it is an object of the present invention to provide an improved RFQ device for accelerating and focusing a charged particle beam which affords large mechanical tolerances, good mechanical stability, and simplicity of fabrication.

It is another object of the present invention to provide an RFQ device which is of relatively simple geometry, making use of eight coupled T-sections, and which is particularly adapted for fabrication from a superconducting material such as niobium, for accelerating and focusing ion beams.

Yet another object of the present invention is to provide a rod and post structure for an RFQ device with four-fold rotation symmetry which employs four large diameter longitudinal rods and a plurality of radial posts for enhanced mechanical stability.

A further object of the present invention is to provide an RFQ device having large electric field coupling between four longitudinal rods, or vanes, high magnetic field coupling between adjacent quadrants, and relatively weak inductive coupling between radial posts coupled to and supporting the longitudinal rods for use as a focusing element in a continuous wave, high current ion beam linear accelerator.

These objects of the present invention are achieved and the disadvantages of the prior art are eliminated by a radio frequency quadrupole (RFQ) device for focusing and accelerating a beam of charged particles, the RFQ device comprising: a housing having first and second apertures aligned along an axis for respectively receiving the beam of charged particles into the housing and passing the beam of charged particles out of the housing; four conductive, linear rods disposed within the housing and aligned with and disposed symmetrically about the axis and extending substantially between the first and second apertures; and a plurality of linear posts each aligned radially relative to the axis, wherein each of said posts is coupled at an inner end thereof to a respective one of the rods and an outer end of each post is coupled to the housing for supporting the rods in the housing

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
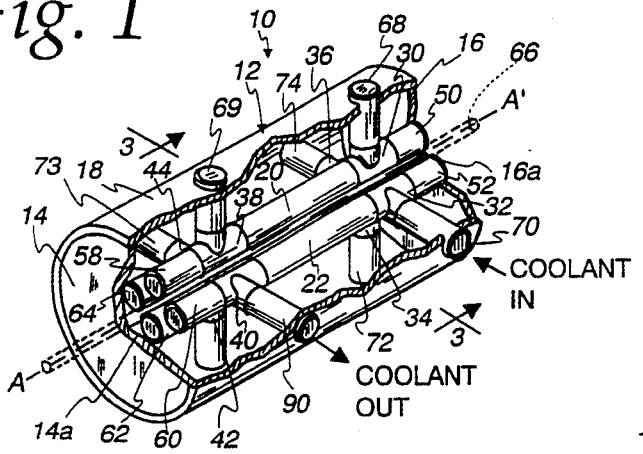
FIG. 1 is a partially cut-away perspective view of an RFQ device for accelerating charged particles in accordance with the principles of the present invention.

Referring to FIG. 1, there is shown a partially cut-away perspective view of an RFQ device 10 in accordance with the present invention. The RFQ device 10 includes an outer, cylindrical shaped housing 12 having first and second opposed, generally planar end walls 14 and 16 and a cylindrical side wall 18 disposed intermediate the two end walls. Each of the first and second end walls 14, 16 includes a respective through-hole circular aperture 14*a* and 16*a*. Housing 12 functions as an accelerating and focusing unit for an ion beam 66 (shown in the figure in dotted-line form) directed through the apertures 14*a* and 16*a* in the first and second end walls 14, 16 and along an axis A–A'. The cylindrical side wall 18 functions as a support tube for an RF conductive structure disposed within the housing 12 which is described in detail in the following paragraphs.

Figure 2:
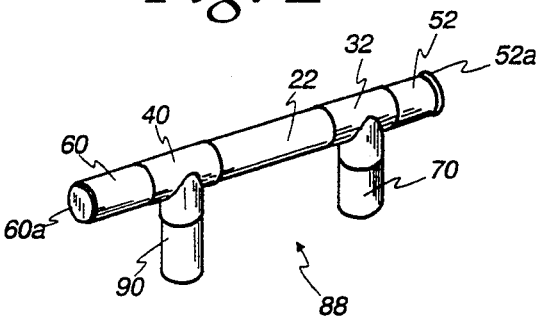
FIG. 2 is a perspective view of a vane structure including two T-sections for use in an RFQ device in accordance with the present invention.
Figure 3:
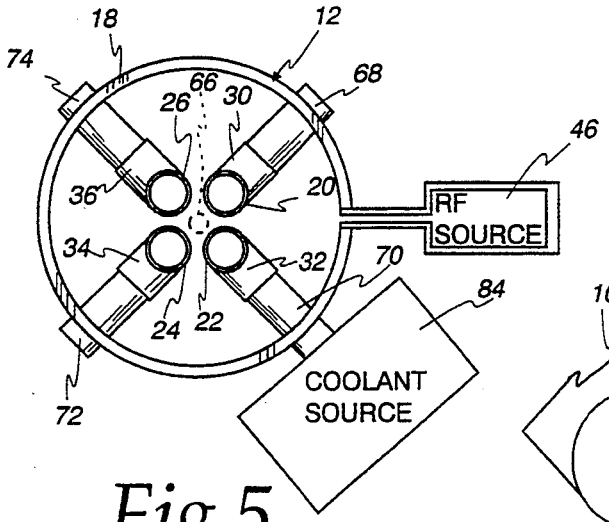
FIG. 3 is a medial transverse sectional view of the RFQ device shown in FIG. 1 taken along site line 3—3 therein.

Referring to FIG. 1 as well as to FIG. 3, which is a medial transverse sectional view of the RFQ device 10 shown in FIG. 1 taken along site line 3—3 therein, the internal structure as well as the operation of the RFQ device will now be described. Disposed within housing 12 are four essentially identical rod and post assemblies. A perspective view of one of the rod and post assemblies 88 is shown in FIG. 2. Each rod and post assembly includes a respective longitudinal, linear, tubular inner rod which are identified as elements 20, 22, 24 and 26 in the figures. Each rod and post assembly further includes pairs of transverse posts each coupled to an associated inner rod forming a T-section. Thus, as shown in FIG. 1, longitudinal rod 22 is coupled to posts 70 and 90 forming the respective T-sections 32 and 40. Similarly, longitudinal rod 20 is coupled to transverse posts 68 and 69 forming T-sections 30 and 38, respectively. Similarly, longitudinal rods 24 and 26 are coupled to respective pairs of transverse posts (with only posts 73 and 74 shown in FIG. 1 for simplicity) forming associated T-sections (with only T-sections 34, 42 and 44 shown in FIG. 1 for simplicity)° As shown in the sectional view of FIG. 3, adjacent ends of the four longitudinal rods 20, 22, 24 and 26 are respectively coupled to posts 68, 70 72 and 74 forming T-sections 30, 32, 34 and 36. With an inner end of each of the posts coupled to a longitudinal rod, the outer end of each post is coupled to the cylindrical side wall 18 of housing 12. The longitudinal rods may be hollow or solid.

Referring to the rod and post assembly 88 shown FIG. 2, the outer ends of each of the longitudinal rods 52 and 60 are provided with a respective cap 52*a* and 60*a*. Each of the end caps 52*a*, 60*a*, is securely attached to the outer end of outer rods 52, 60, respectively, by conventional means such as weldments. Similarly, weldments may be used to connect each of the T-sections to respective inner and outer rods as well as to a respective post. In a preferred embodiment, the rod and post assemblies are comprised of a superconducting material such as niobium.

A coolant can be circulated through each rod and post assembly such as shown in FIG. 1 for the rod and post assembly comprised of inner rod 22, end rods 52 and 60, and posts 70 and 90. A coolant source 84 is shown coupled to post 70 in FIG. 3, although the coolant source has been omitted from FIG. 1 for simplicity, it being understood that the three remaining rod and post assemblies are also coupled to the same, or to another, coolant source. For a superconducting embodiment, the coolant would preferably be liquid helium, while a normal conducting embodiment would use a coolant such as water. The coolant circulated through each of the rod and post assemblies limits the temperature of the structure within housing 12 to provide improved mechanical stability and to ensure that the original geometry of the superconducting RF device 10 is maintained during operation. FIG. 3 also shows an RF source 46 coupled to housing 12 for introducing RF energy into the housing. In one embodiment, the RF energy introduced into housing 12 is at 194 MHz, while the housing is 50 centimeters in length, with beam passing end apertures 14*a* and 16*a* each having a radius of 4 millimeters.

Figure 4:
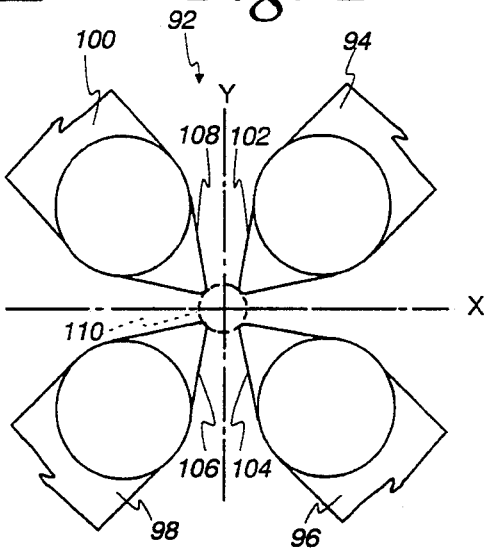
FIG. 4 is a simplified sectional view of the four vane structure in the RFQ device of FIG. 1 illustrating the full vane structure.

Referring to FIG. 4, there is shown a sectional view of another embodiment of a symmetrical four rod RFQ structure 92 in accordance with the principals of the present invention. FIG. 4 is a sectional view of the RFQ structure 92 taken transverse to the axis of a charged particle beam 110 and through four symmetrically disposed T-sections 94, 96, 98 and 100 within the RFQ device's housing which is not shown in the figure for simplicity. Each of the four T-sections 94, 96, 98 and 100 is coupled to a respective rod, or vane, 102, 104, 106 and 108 as previously described. In the embodiment of FIG. 4, each of the longitudinal rods 102, 104, 106 and 108 has a tear-drop shaped cross section and includes a tapered portion extending toward the axis of the charged particle beam 110. The rod cross sectional shape in RFQ structure 92 provides a full vane structure for improved acceleration and focusing of the charged particle beam 110.

Figure 5:
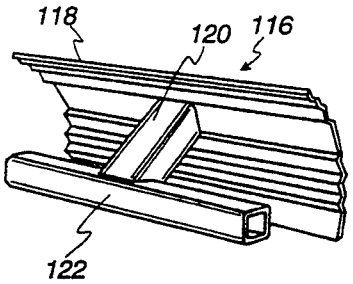
FIG. 5 is a partial perspective view of another embodiment of an RFQ device in accordance with the present invention illustrating details of the coupling between a radial post and a longitudinal rod within an outer accelerator shell.

Referring to FIG. 5, there is shown a partial perspective view of yet another embodiment of an RFQ device 116 in accordance with the present invention. In the embodiment shown in FIG. 5, a radial post 120 having a generally rectangular (or square) cross section connects an axial rod, or vane, 122 to the cylindrical side wall 118 of the RFQ device 116. Axial rod 122 also includes a generally rectangular (or square) cross sectional shape. In the embodiment of the RFQ device 116 shown in FIG. 5, conventional means such as weldments are used to directly couple radial post 120 to axial rod 122 as well as to couple the radial post to the cylindrical side wall 118 of the RFQ device 116.

There has thus been shown an improved RFQ device employing four spaced elongated, linear, tubular rods disposed parallel to a charged particle beam axis and within a housing having a pair of opposed apertures on respective ends thereof for passing the beam. Each rod is supported by several spaced posts oriented radially with respect to the beam axis. In one embodiment, T-section couplers are used for connecting a pair of radial posts with each rod. In another embodiment, the axial rods are provided with a tapered portion extending inwardly toward the beam axis to provide a full vane structure. The rod and post geometry has four-fold rotation symmetry, while maintaining large dipole-quadrupole mode separation to accommodate a range of mechanical tolerances. The quadrupole structure provides a high degree of mechanical stability, employs a repeating unit of simple T-sections, is particularly adapted for fabrication of superconducting materials such as niobium, and is insensitive to mechanical displacement. The RFQ device can be easily and economically fabricated and assembled because the large quadrupole-dipole mode splitting ensures that good electrodynamic properties can be achieved without requiring close mechanical tolerances. Forming the resonant cavity by joining together a number of identical small parts of a simple and easily fabricated shape, such as halves of a T-section, facilitates fabrication of the inventive RFQ device from superconducting materials.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. A radio frequency quadrupole (RFQ) device for focusing and accelerating a beam of charged particles, said RFQ device comprising:

a housing having first and second apertures aligned along an axis for respectively receiving the beam of charged particles into said housing and passing the beam of charged particles out of said housing;

four conductive, linear rods disposed within said housing and aligned with and disposed symmetrically about said axis and extending substantially between said first and second apertures; and a plurality of linear posts each aligned radially relative to said axis, wherein said posts are disposed symmetrically about said axis and each of said posts is coupled at an inner end thereof to a respective one of said rods and an outer end of each post is coupled to said housing for supporting said rods in said housing, and wherein said rods and posts are arranged in four-fold rotation symmetry about said axis.

2. The RFQ device of claim 1 further comprising a plurality of tubular T-couplers connecting each post to a respective one of said rods.

3. The RFQ device of claim 1 wherein said housing is generally cylindrical having a curvilinear side wall and first and second opposed planar end walls respectively including said first and second apertures.

4. The RFQ device of claim 3 wherein said curvilinear side wall of said housing includes a plurality of spaced apertures each disposed adjacent to and continuous with an outer end of a respective post.

5. The RFQ device of claim 3 further comprising an RF energy source coupled to the curvilinear side wall of said housing for directing RF energy into said housing.

6. The RFQ device of claim 5 wherein said RF source is coupled to said curvilinear side wall of said housing at a location substantially equally spaced from the first and second opposed end walls of said housing.

7. The RFQ device of claim 1 wherein said rods and posts have a curvilinear cross sectional shape.

8. The RFQ device of claim 7 wherein said cross sectional shape is circular.

9. The RFQ device of claim 7 wherein said rods each have a tapered portion extending toward said beam axis and said posts each have a circular cross sectional shape.

10. The RFQ device of claim 1 wherein said rods and posts are comprised of a superconducting material.

11. The RFQ device of claim 10 wherein said superconducting material is niobium.

12. The RFQ device of claim 1 wherein each of said posts and rods is tubular having a hollow inner portion.

13. The RFQ device of claim 12 further comprising a coolant source coupled to each pair of posts for circulating a coolant through said posts and said rods.

14. The RFQ device of claim 13 wherein said rods and posts are comprised of a superconducting material and said coolant is liquid helium.

15. The RFQ device of claim 13 wherein said rods and posts are comprised of non-superconducting material and said coolant is water.

16. The RFQ device of claim 1 wherein a plurality of posts is coupled to each of said rods.

17. The RFQ device of claim 16 further comprising a plurality of tubular T-couplers each connecting a post to a respective rod, wherein said T-couplers are disposed in a spaced manner along each of said rods.

18. A four-vane RFQ device comprising:

a substantially closed housing having a first inlet aperture an a second outlet aperture in mutual alignment for allowing a beam of charged particles to pass through said housing along a beam axis;

an RF energy source coupled to said housing for directing RF energy into said housing;

four conductive elongated, linear, tubular vanes disposed within said housing symmetrically about said beam axis and extending substantially between said firs inlet and said second outlet apertures; and a plurality of conductive elongated, linear tubular posts radially aligned with and disposed symmetrically about said beam axis, wherein each post couples a respective vane to said housing and provides support for said respective vane, and wherein said vanes and posts are arranged in four-fold rotation symmetry about said beam axis.

19. The RFQ device of claim 18 further comprising a source of coolant connected to each of said vanes via a respective post for circulating a coolant through said vanes.

20. The RFQ device of claim 19 wherein said vanes and posts are comprised of a superconducting material.

21. The RFQ device of claim 20 wherein each of said rods and posts has a curvilinear cross section.

22. The RFQ device of claim 21 wherein each of said rods has a respective tapered portion extending toward said beam axis and each of said posts has a circular cross section.

* * * * *

UNITED STATES PATENT AND TRADEMARK OFFICE

CERTIFICATE OF CORRECTION

PATENT NO. : 5,422,549

DATED : June 6, 1995

INVENTOR(S) : Kenneth W. Shepard and Jean R. Delayen

It is certified that error appears in the above-indentified patent and that said Letters Patent is hereby corrected as shown below:

In column 4, line 7, delete "°" after the word "simplicity)" and insert --.--.

Signed and Sealed this

Twenty-sixth Day of September, 1995

*Attest:*

Bruce Lehman

BRUCE LEHMAN

*Attesting Officer*

*Commissioner of Patents and Trademarks*